US007028619B2

(12) United States Patent
McLemore

(10) Patent No.: US 7,028,619 B2
(45) Date of Patent: Apr. 18, 2006

(54) COLLECTABLE PERSONAL DISPLAY SHELF

(76) Inventor: Gregory June McLemore, 204 Madison St., Franklin, VA (US) 23851

( * ) Notice: Subject to any disclaimer, the term of this patent is extended or adjusted under 35 U.S.C. 154(b) by 209 days.

(21) Appl. No.: 10/617,144

(22) Filed: Jul. 10, 2003

(65) Prior Publication Data

US 2005/0005824 A1 Jan. 13, 2005

(51) Int. Cl.
*A47B 23/00* (2006.01)

(52) U.S. Cl. ..... 108/42

(58) Field of Classification Search ..... 108/42, 108/152, 48, 43, 46; 211/90.01; D6/300, D6/301, 302, 309
See application file for complete search history.

(56) References Cited

U.S. PATENT DOCUMENTS 4,870,907 A * 10/1989 McKee ..... 108/42
5,433,152 A * 7/1995 Henry ..... 108/42
5,513,575 A * 5/1996 Slade ..... 108/42
6,196,139 B1 * 3/2001 Jensen et al. ..... 108/42
6,318,569 B1 * 11/2001 Rothing ..... 211/90.01
6,539,879 B1 * 4/2003 Current et al. ..... 108/42
6,591,762 B1 * 7/2003 Haghayegh ..... 108/42

* cited by examiner

*Primary Examiner*—Jose V. Chen

(57) ABSTRACT

A personal display shelf having a vertical support surface base, with horizontal transparent shelves, without visible exterior supports. The shelves are individual and geometrically placed to accommodate varying heights of articles. The shelves are designed to support personal fragrance bottles or other reasonably light weight collectables, and mounts on a wall in the home or office with mirror clips or picture hanging apparatus. This display shelf is designed to display collectables in an elegant manor for the owner of treasured collectables while saving space on dresser, sink, or any other traditional place for displaying fragrance bottles or other collectables. The personal display shelf can come in different styles, with a reflective support base or a clear glass support base both accenting the owners personal collectables.

9 Claims, 3 Drawing Sheets

Front View

Front View

Exploded Side View

Fig. 3
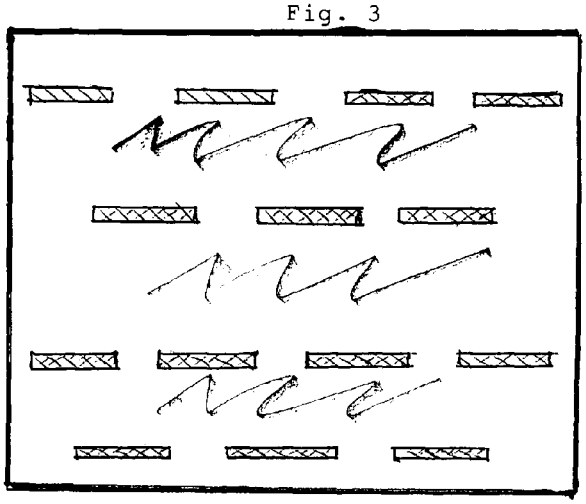
Front View
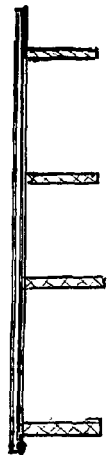
Fig. 4
Side View
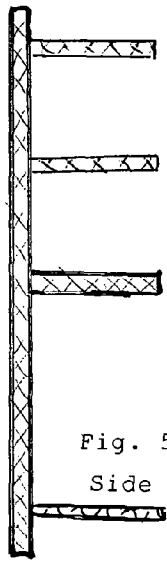
Fig. 5
Side View
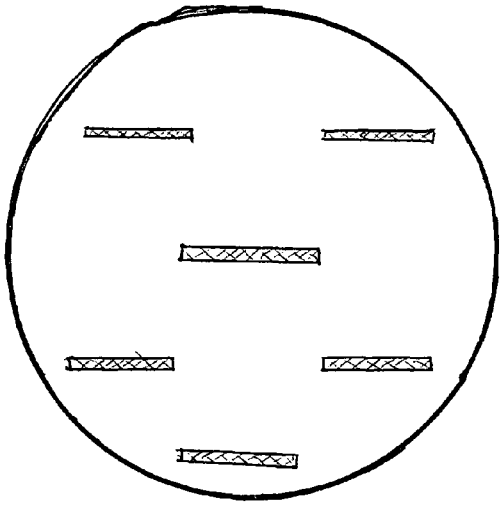
Fig. 6
Front View

Possible Shelf Shapes

COLLECTABLE PERSONAL DISPLAY SHELF

BACKGROUND OF INVENTION

1) This invention is a new version of a display shelf. An invention that has existed for many years in many forms. However until now no such invention has been created to especially display individual articles on individual shelves. This invention was invented to save space and for fragrance collectors to display their own personal collections on.

2) The primary difference from previous art is there is no utility patent in existence for this type of display shelf utilizing this fastening method to securing the horizontal transparent shelf to a vertical support surface with more than one shelf, which allows less support obstructions for placement of individual articles The difference in this invention is what the inventor calls the Mclemore method of invisible support using adhesive, glass, mirror and or acrylic as the only components to create this display shelf device.

3) This product was created to fill a void of any existing product in the market place designed for this purpose. It is art with a function dependent on beauty as much as functionality and practicality to save space in the home. Though this product was invented and designed for use by fragrance collectors. Its functionality and practicality serves many other collectables. Through research it is my opinion that this product falls in the patent class of 108 or 211 according to the opinion of observers who have seen this product at the U.S. patent office

BREIF SUMMARY OF INVENTION

Said invention is called the McLemore Personal Fragrance & Specialty Display Shelf. named after fragrance collector and inventor G. McLemore, for the type of method used in its support system and construction. The McLemore personal display shelves were invented to save space while offering collectors of fine fragrances a way to elegantly display their own personal collections at home or in the office.

The displays are made to be easily mounted to a wall by mirror clips or picture hanging devises with ease. The displays offer individual transparent shelves to accommodate individual articles, on a clear or reflective support surface. The shelves which can consist of one or more are permanently affixed with ™E-6000 adhesive with supporting strength of up to 3500 pounds per square inch. The shelves are geometrically configured to allow varying heights of articles. The support method for the shelves appears invisible and allows more room for article without support obstructions. The displays can be designed in many styles and shelf configurations. The new way to display in a new millennium

BRIEF DESCRIPTION OF THE SEVERAL VIEWS OF THE DRAWINGS

There are two separate pages of drawings figures for this invention, illustrating the two relevant views and one exploded view which are as follows:

Figure Views:

FIG. 1 Element B: of FIG. 1 is a clear horizontal support shelf for article.

FIG. 2 Elements A: of FIG. 2 is a Vertical support surface front made of glass, plexi-glass or mirror.

FIG. 2 Element B: of FIG. 2 is a Horizontal transparent shelf made of glass, plexi-glass or mirror.

FIG. 2 Element C: of FIG. 2 is the point on front support surface where adhesive is applied, adhesive is also applied to rear edge of clear horizontal shelf or shelves.

FIG. 2 Element D: of FIG. 2 is the rear of vertical support surface that mounts to a wall FIG. 3 Front view of 14 horizontal transparent shelves on a reflective vertical support surface illustrating shelf patterning to allow taller individual articles to fit on individual shelves FIG. 4 Side view of FIG. 3 illustrating no visible supports or obstructions by exterior supports FIG. 5 Side view of FIG. 6 illustrating regardless of vertical support shape horizontal shelf support practices the same benefits and function FIG. 6 Front view of 6 horizontal transparent shelves on a round transparent vertical support surface demonstrating benefits of shelf patterning and absence of support obstructions.

DETAILED DESCRIPTION OF THE INVENTION

Figure 1:
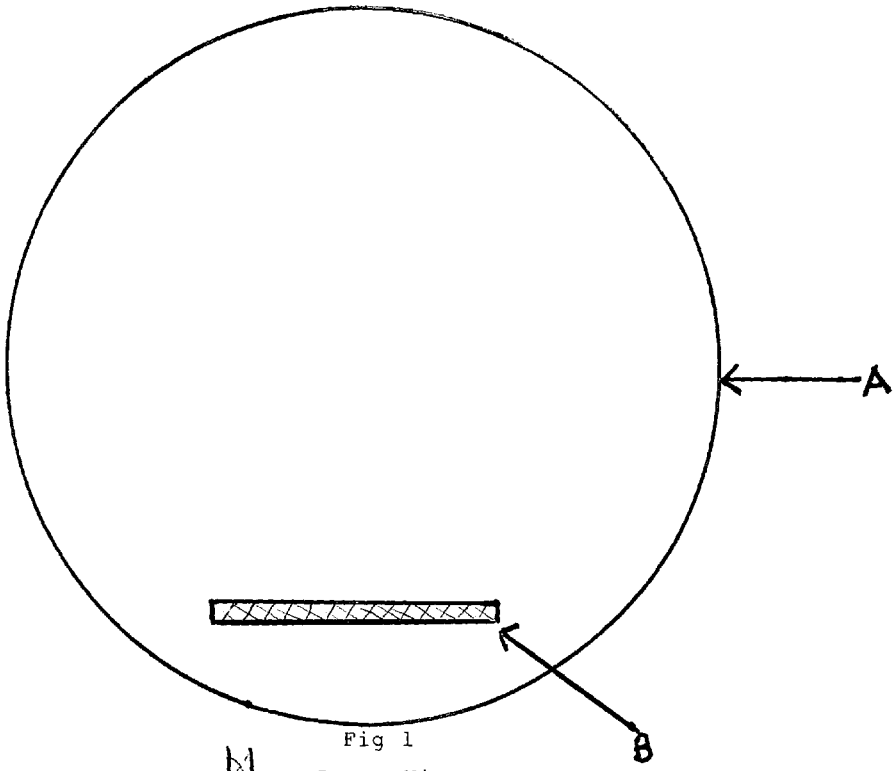
FIG. 1 Element A: of FIG. 1 is a vertical support surface in a round shape made of glass, plexi-glass or mirror.
Figure 2:
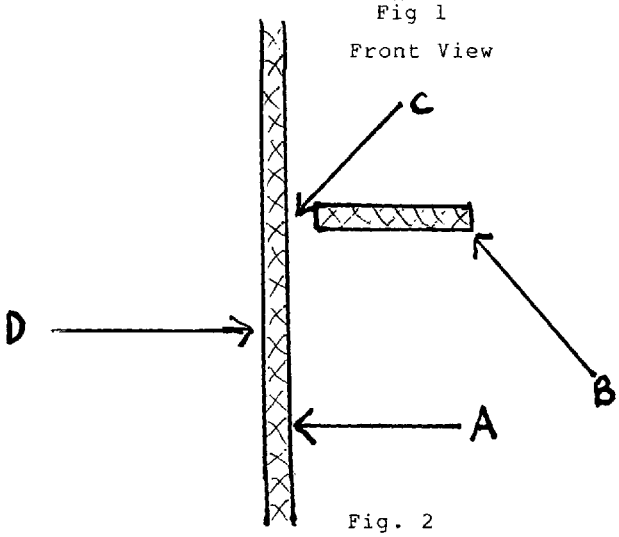
FIG. 2 Exploded side view.
Figure 7:
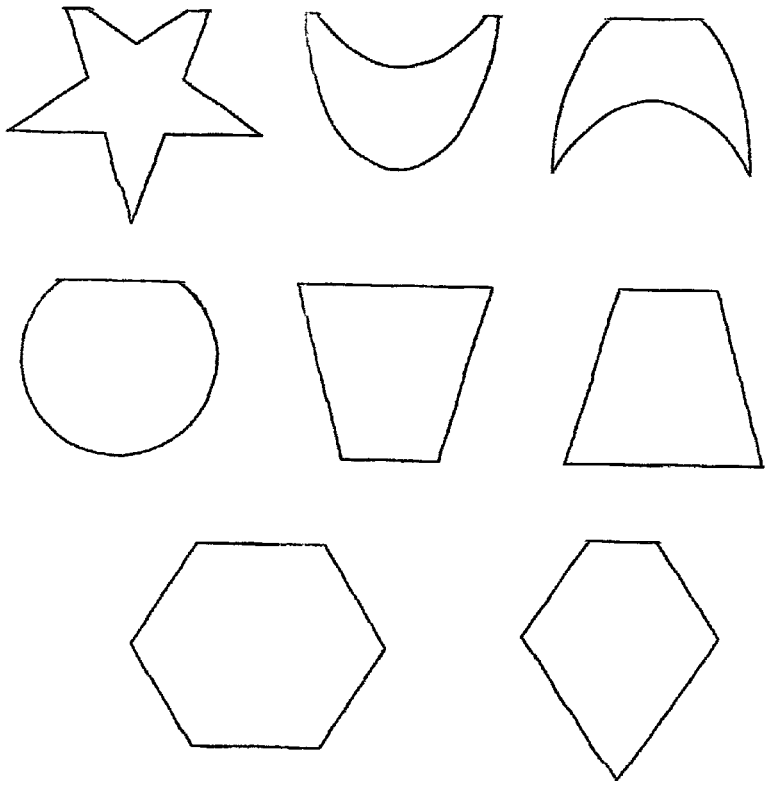
FIG. 7 Top view of different shapes of shelves as indicated in claim 11 With the phrase any shape.

1. The invention is a personal display shelf having a vertical support base surface, with horizontal ¼ inch transparent individual shelf or shelves that are exclusively attached to the support surface base by an adhesive compound called E-6000, which eliminate exterior supports. This display shelf is the first display shelf designed especially to support personal fragrance bottles or other reasonably light weight collectables elegantly and mounts on a wall in the home or office with mirror clips or picture hanging apparatus.

2. The difference between a Mclemore personal display shelf and previously created displays or shelves, is the mounting process. Individual glass or acrylic shelves creating invisible sturdy support, without visible exterior supports. Also with varying fixed placement of shelves that allow more room for placement of articles of various heights.

3. Mclemore personal displays are easily movable from room to room due to the simplicity of the wall mounting processes. All previous methods for mounting glass shelves requires the use of some sort of screws, brackets, braces or fasteners which are usually visible and because of the composition of glass, not conducive to screws into glass shelves for support.

4. The Mclemore personal displays use only glass, or reflective surface such as mirror for its vertical back support surface, the shelves are made from glass or acrylic. The construction of said display is achieved by building the display in a horizontal position with the shelves affixed with vertical placement to allow the adhesive compound to cure for a prescribed curing time before trimming excess adhesive. Though the adhesive specifications for the compound allows up to 3500 pounds per square this display shelf is designed to display light weight collectables in an elegant manor for the owner of treasured collectables while saving space on dresser, sink, or any other traditional place for displaying fragrance bottles or other collectables.

5. Though the shelves are permanently affixed, they are positioned to allow for different size bottles. The shelves also can vary in width from one to twelve inch's. The personal display shelf can come in different styles, with a reflective support base or a clear support base both accenting the owners personal collectables in a way never before available with conventional display shelving.

I claim:

1. A display shelf apparatus comprising a main support surface, said main support surface being glass plate, a plurality of planar shelves, said plurality of planar shelves being transparent and including a back edge, said plurality of planar shelves attached to said main support surface at said back edge using a sole support, wherein the said plurality of planar shelves extend perpendicular from said main support surface, said sole support being an adhesive, said plurality of planar shelves placed in varying patters on said main support surface to accomodate articles that are not of the same heights, said display shelf apparatus including hanging apparatus so as to be attached to a vertical support surface.

2. The display shelf apparatus of claim 1 wherein the main support surface has a square shape.

3. The display shelf apparatus of claim 1 wherein the main support surface has a circular shape.

4. The display shelf apparatus of claim 1 wherein the main support surface is a mirror.

5. The display shelf apparatus of claim 1, wherein the display shelf apparatus is plexiglass.

6. The shelf display apparatus of claim 1, wherein the plurality of planar shelves have a width between 1 and 12 inches.

7. The shelf display apparatus of claim 1, wherein the display shelf apparatus includes an ornamental frame.

8. The display shelf apparatus of claim 1, wherein the display shelf apparatus has a rectangular shape.

9. The display shelf apparatus of claim 1, wherein the display shelf apparatus is acrylic.

* * * * *